US007798921B2

(12) United States Patent
Connerley

(10) Patent No.: US 7,798,921 B2
(45) Date of Patent: Sep. 21, 2010

(54) MULTI-DIRECTIONAL BREAK-AWAY GOAL

(75) Inventor: James J. Connerley, Noblesville, IN (US)

(73) Assignee: Gared Holdings, LLC, Noblesville, IN (US)

( * ) Notice: Subject to any disclaimer, the term of this patent is extended or adjusted under 35 U.S.C. 154(b) by 0 days.

(21) Appl. No.: 12/580,659

(22) Filed: Oct. 16, 2009

(65) Prior Publication Data

US 2010/0035707 A1 Feb. 11, 2010

Related U.S. Application Data

(62) Division of application No. 11/332,920, filed on Jan. 17, 2006, now Pat. No. 7,628,718.

(51) Int. Cl.
*A63B 63/08* (2006.01)

(52) U.S. Cl. ..... 473/485; D21/701

(58) Field of Classification Search ..... 473/476–486; D21/701

See application file for complete search history.

(56) References Cited

U.S. PATENT DOCUMENTS

| | | | | |
|---|---|---|---|---|
| 3,233,898 A | | 2/1966 | Sheets et al. | 273/1.5 |
| 4,111,420 A | | 9/1978 | Tyner | 273/1.5 R |
| 4,194,734 A | | 3/1980 | Tyner | 273/1.5 R |
| 4,365,802 A | | 12/1982 | Ehrat | 273/1.5 R |
| 4,433,839 A | | 2/1984 | Simonseth | 273/1.5 R |
| 4,441,709 A | * | 4/1984 | Schroeder et al. | 473/486 |
| 4,534,556 A | | 8/1985 | Estlund et al. | 273/1.5 R |
| 4,723,777 A | | 2/1988 | Jolly | 273/1.5 R |
| 5,106,084 A | * | 4/1992 | Vaught | 473/486 |
| 5,348,289 A | | 9/1994 | Vaught | 273/1.5 R |
| 5,464,207 A | * | 11/1995 | Boitano | 473/486 |
| 5,480,139 A | * | 1/1996 | Owen et al. | 473/486 |
| 5,586,759 A | | 12/1996 | Fitzsimmons et al. | 273/1.5 R |
| 5,628,506 A | | 5/1997 | Vaught | 473/486 |

(Continued)

FOREIGN PATENT DOCUMENTS

GB 854885 11/1960

(Continued)

*Primary Examiner*—Gene Kim
*Assistant Examiner*—M Chambers
(74) *Attorney, Agent, or Firm*—Brinks Hofer Gilson & Lione

(57) ABSTRACT

A basketball rim mounting assembly permitting multi-directional deflection in response to extraordinary forces imposed on the rim has a fixed portion coupled to a back board and a movable portion fixed to a basketball rim. The fixed portion can include a back plate secured to a front face of the back board, a pair of bracket plates fixed to extend forward from the back plate, and a base plate fixed between the bracket plates. The movable portion can include a top plate overlying the base plate and a pair of side plates extending downward from the top plate outside the bracket plates. A pair of downwardly extending members is fixed to the top plate in spaced relation to each other. Tilt regulating structure is coupled between the pair of downwardly extending members and to the fixed portion for controlling the extent of deflection of the rim relative to the backboard such that the extraordinary force necessary to cause the rim to break-away from its normal position is the same in any direction.

8 Claims, 8 Drawing Sheets

U.S. PATENT DOCUMENTS

| | | | | |
|---|---|---|---|---|
| 5,685,790 | A | 11/1997 | Vaught | 473/486 |
| 5,716,294 | A * | 2/1998 | Childers et al. | 473/486 |
| 5,816,955 | A | 10/1998 | Nordgran et al. | 473/486 |
| 5,830,090 | A * | 11/1998 | Fitzsimmons et al. | 473/486 |
| 6,080,071 | A | 6/2000 | Childers et al. | 473/486 |
| 6,186,911 | B1 * | 2/2001 | Manthey | 473/486 |
| 6,296,583 | B1 | 10/2001 | Tatar | 473/486 |
| 6,447,409 | B1 * | 9/2002 | Squibb | 473/486 |
| 6,503,160 | B2 | 1/2003 | Hehr | 473/486 |
| 6,935,972 | B2 | 8/2005 | Hehr | 473/486 |
| 7,175,551 | B1 | 2/2007 | Hamilton | 473/486 |
| 7,214,148 | B2 | 5/2007 | Mahoney | 473/486 |
| 2003/0054906 | A1 * | 3/2003 | Allshouse et al. | 473/486 |
| 2007/0167265 | A1 | 7/2007 | Connerley | 473/485 |

FOREIGN PATENT DOCUMENTS

| | | |
|---|---|---|
| GB | 900208 | 7/1962 |

* cited by examiner

MULTI-DIRECTIONAL BREAK-AWAY GOAL

CROSS-REFERENCE TO RELATED APPLICATIONS

This application is a divisional of U.S. application Ser. No. 11/332,920 filed Jan. 17, 2006 now U.S. Pat. No. 7,628,718.

BACKGROUND OF THE INVENTION

The present invention relates to basketball goals, consisting generally of a basket, rim, and support, which are capable of deflecting in a variety of directions upon application of sufficient force, such as from a dunk shot, the deflection preventing damage to the rim and associated backboard to which the goal is mounted. The present invention relates particularly to such a goal that can automatically return to an original position upon removal of the force.

U.S. Pat. Nos. 4,111,420 and 4,194,734 disclose an energy absorbing basketball goal/backboard unit that incorporates a conventional vertically aligned backboard and horizontally aligned goal, i.e., the basket. The goal is spring mounted to pivot relative to the backboard forwardly and downwardly out of its normal horizontal plane when a predetermined excess force is applied such as when a player dunks the basketball and slaps, hits or pulls the goal with his hands, wrists, or arms. The goal returns to its original position with the energy of the return motion being dissipated by shock absorbing means. Provision can also be made for the goal to deflect sideward under spring and shock absorbing restraint. The spring providing the return forces and the shock absorbing means are mounted behind the backboard and connected to the goal by members extending though openings in the backboard.

U.S. Pat. No. 4,365,802 discloses a basketball goal-backboard unit including a backboard of glass, a rigid frame surrounding the backboard, a shock-absorbing assembly having a front plate and a rear plate disposed in registering relationship forwardly and rearwardly, respectively, of the backboard. Cushioning panels are snugly disposed between the backboard adjacent faces of the front and rear plates and the backboard, and with the basketball goal incorporating a mounting element disposed on the forward face of the front plate. A single bolt interengages the basketball goal mounting element, the front and rear plates, and the cushioning panels. A fluid cylinder can be presented rearwardly of the backboard, being mounted upon the frame, and having a piston operatively engaged at the rearward plate.

U.S. Pat. No. 4,433,839 discloses a basketball rim assembly especially adapted to relieve forces which normally are imparted to the backboard of conventional basketball rim assemblies. There is a rim of conventional configuration mounted to a support plate which fits against the forward face of the backboard. There is a rear support plate on the backside of the backboard fixedly attached to the front plate. This rear plate in turn transmits loads exerted thereon into a base frame structure. Additionally, the rim is provided with a release mechanism which permits it to rotate downwardly from its horizontal position when an impact load of sufficient magnitude is exerted on the rim such as those occurring in the execution of a dunk shot.

U.S. Pat. No. 4,723,777 discloses a basketball goal for mounting on a backboard for providing absorption and dissipation of the energy occurring during a dunk shot or the like. The rim of the goal is pivotally mounted to the backboard and held in place by means of a spring and fluid filled hydraulic piston-cylinder mechanism, which are mounted between the backboard and the rim. A downward force on the rim is opposed primarily by a vertical coil spring surrounding the cylinder. The cylinder and spring are coaxial with the axis being substantially parallel to the plane of the backboard. The downward motion of the rim opens a valve in the piston-cylinder allowing the cylinder to be moved upwardly with the downward movement of the rim with substantially no hydraulic restrictions. When the rim begins its return to normal position under spring pressure, the valve is closed. The piston has a predetermined diameter smaller than the inside diameter of the cylinder. Expansion of the compressed spring forces the piston upwardly, with the space between the piston wall and cylinder wall creating a limited flow of the fluid so as to cushion and dampen the return of the rim to its normal position.

U.S. Pat. No. 5,685,790 discloses a basketball goal having support structure adapted to be mounted to a backboard, and rim structure including a rim, mounted to the support structure. The basketball goal further includes a rim support assembly including a clamp, a spring and a rigid member. The clamp is mounted to the rim support assembly and has a clamped position for maintaining the rim in a horizontal position, and an unclamped position enabling the rim to swing downwardly in an arcuate path. The spring is operatively mounted to the clamp for maintaining the clamp in the clamped position, and for permitting the clamp to assume the unclamped position and move in the arcuate path upon application of a predetermined force to the rim. The rigid member supports the spring, and is mounted for swinging movement along another arcuate path upon application of the predetermined force to the rim, thereby preventing damage to the spring when the clamp assumes the unclamped position.

U.S. Pat. Nos. 5,716,294 and 6,080,071 discloses a breakaway basketball rim assembly in which there is a release assembly which operably interconnects the base member and the rim member, the release assembly being configured to release the rim member in response to a downward load which is received at any point along an extended frontal arc of the circular hoop, so that the hoop tilts downwardly generally in the direction of the load. There is also a reaction load mechanism for returning the hoop to its horizontal playing position. A U-shaped fulcrum joint extends between the reaction load in the hoop so as to provide a pivot point in line between the reaction load and any impact point along the extended frontal arc of the hoop. The joint is configured so that the rim releases in response to a substantially identical impact load anywhere along the frontal arc.

U.S. Pat. No. 6,447,409 discloses a breakaway basketball rim assembly with a mounting unit with a vertical baseplate and a horizontal mounting plate, and a rim unit having a circular hoop portion and a pivot plate that projects rearwardly from the hoop portion in spaced relation above the mounting plate. A ball bearing is positioned between the pivot plate and the mounting plate to provide the pivot point for releasing the rim unit when a downward load is placed upon the hoop portion. At least one stop is placed on top of the mounting plate to restrict the movement of the pivot plate and load a plurality of spring-loaded attachments that extend from the pivot plate through the mounting plate to return the rim unit to a generally horizontal position.

U.S. Pat. Nos. 6,503,160 and 6,935,972 disclose a breakaway basketball rim assembly in which the mounting bracket and rim are operably interconnected by a torsion rod which twists resiliently in response to an impact or other downward load on the rim. The torsion rod may extend parallel to the backboard, with one end being fixedly mounted to the mounting bracket and the other end being fixedly mounted to the rim, so that the torsion rod allows the rim to deflect downwardly about an axis that extends parallel to the backboard. The torsion rod may be mounted to overlapping flanges on the mounting bracket and the rim. There may also be a longitudinal torsion rod that extends perpendicular to the transverse torsion rod, so as to permit the rim to deflect downwardly about axes that extend both parallel and perpendicular to the backboard.

Despite the various features and benefits of the structures of the forgoing disclosures, there remains a need for an inexpensive, compact basketball rim support that permits controlled deflection of the rim in a variety of directions, while maintaining the rim at the conventional position during any normal impact between a basketball and the rim, and includes an automatic return mechanism for returning the rim to its original position without have to resort to any manual reset of that position.

SUMMARY OF THE INVENTION

These several needs are satisfied by a basketball rim mounting assembly that is designed to allow multi-directional deflection in response to extraordinary forces imposed on the rim. The rim mounting assembly has a fixed portion coupled to a back board and a movable portion fixed to the basketball rim. The fixed portion can include a back plate secured to a front face of the back board, a pair of bracket plates fixed to extend forward from the back plate, and a base plate fixed between the bracket plates. The movable portion can include a top plate overlying the base plate and a pair of side plates extending downward from the top plate outside the bracket plates. A pair of downwardly extending members is fixed to the top plate in spaced relation to each other. Tilt regulating structure is coupled between the pair of downwardly extending members and to the fixed portion for controlling the extent of deflection of the rim relative to the backboard. The tilt regulating structure is such that the extraordinary force necessary to cause the rim to break-away from its normal position is the same in any direction.

The tilt regulating structure can take a form wherein each of the pair of members fixed to the top plate is coupled to one of a first arm and a second arm mounted on the fixed portion so that movement of the movable portion is translated into relative movement between the first and second arms. A pivot axis member can be fixed to the fixed portion and the first arm and the second arm mounted on the pivot axis member. A biasing element resists relative movement of the first and second arms, while at least one displacement element causing relative displacement between the first and second arms upon movement of the movable portion relative to the fixed portion. The at least one displacement element can take the form of a number of balls received between confronting depressions in the first and second arms.

The tilt regulating structure can also take a form wherein each of the pair of members fixed to the top plate comprises an axis defining structure coupled to a pivot bridge member located between the pair of members forming a gimbaled connection between the movable portion and the fixed portion. The gimbaled connection is completed by further axis defining structure fixed to the fixed portion, the axis thusly defined being perpendicular to the axis defining structure fixed to the top plate. A biasing element is provided that resists movement of the pivot bridge that can take the form of a pair of springs positioned on laterally opposite sides of the second axis and forward of the first axis so that the rim is automatically returned to the original set position.

One feature of the present invention is the tilt regulating structure which is such that the extraordinary force necessary to cause the rim to break-away from its normal position is the same in any direction. Another feature of the present invention is the compactness of the tilt regulating structure which is situated below the top plate of the movable portion and in front of the back plate of the fixed portion within a volume that can be secured by a cover plate to prevent tampering with the tilt regulating structure. Such structure has distinct advantages over the various prior art wherein the tilt regulating structure was found behind the back board, and wherein the force necessary to cause the rim to break-away varies depending on the location on the rim of the applied extraordinary force.

Other features of the present invention and the corresponding advantages of those features will be come apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DESCRIPTION OF PREFERRED EMBODIMENTS

Figure 1:
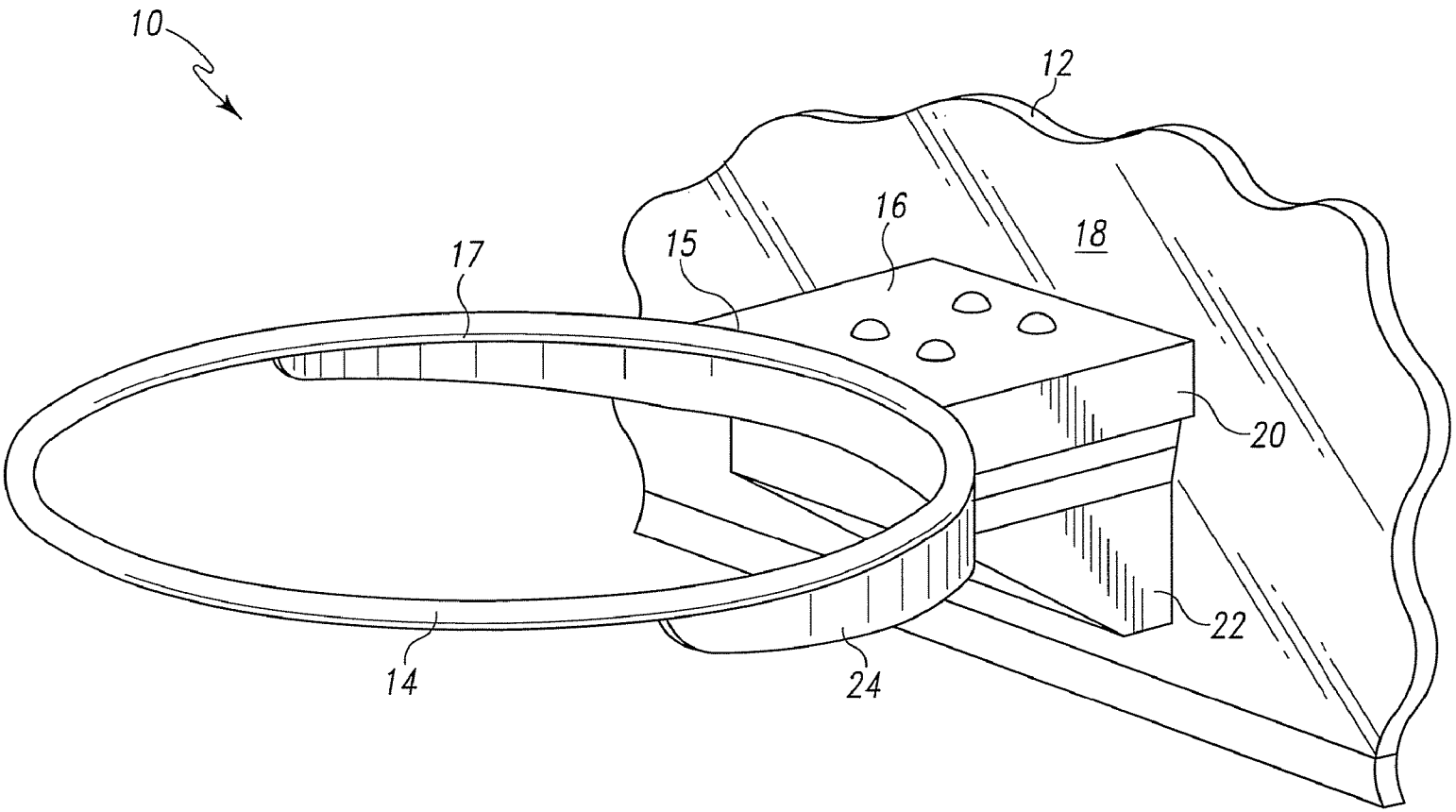
FIG. 1 is a perspective view of a basketball goal of the present invention mounted to a backboard.

A basketball goal 10 is shown in FIG. 1 mounted to a vertical backboard 12 so that the rim 14 of the goal 10 is in the conventional horizontal position. A net, not shown, can be suspended from the rim 14 in the usual manner. The rim 14 is fixed to a top plate 16, which extends from a back segment 15 of the rim to the front surface 18 of the backboard 12. Side plates 20 can be fixed to the top plate 16 to extend downward over, and outside of, bracket plates 22, which are fixed to the backboard 12. An arcuate reinforcement 24 can be provided over a further back segment 17 of the rim 14 to ensure that the rim has the desired stability with respect to the top plate 16 and side plates 20. The rim 14, top plate 16, side plates 20 and reinforcement 24 are joined together to form a unitized structure that can move as a movable portion 26 in relation to the backboard 12, bracket plates 22, and other structure, described below, that is fixed to the backboard 12.

Figure 2:
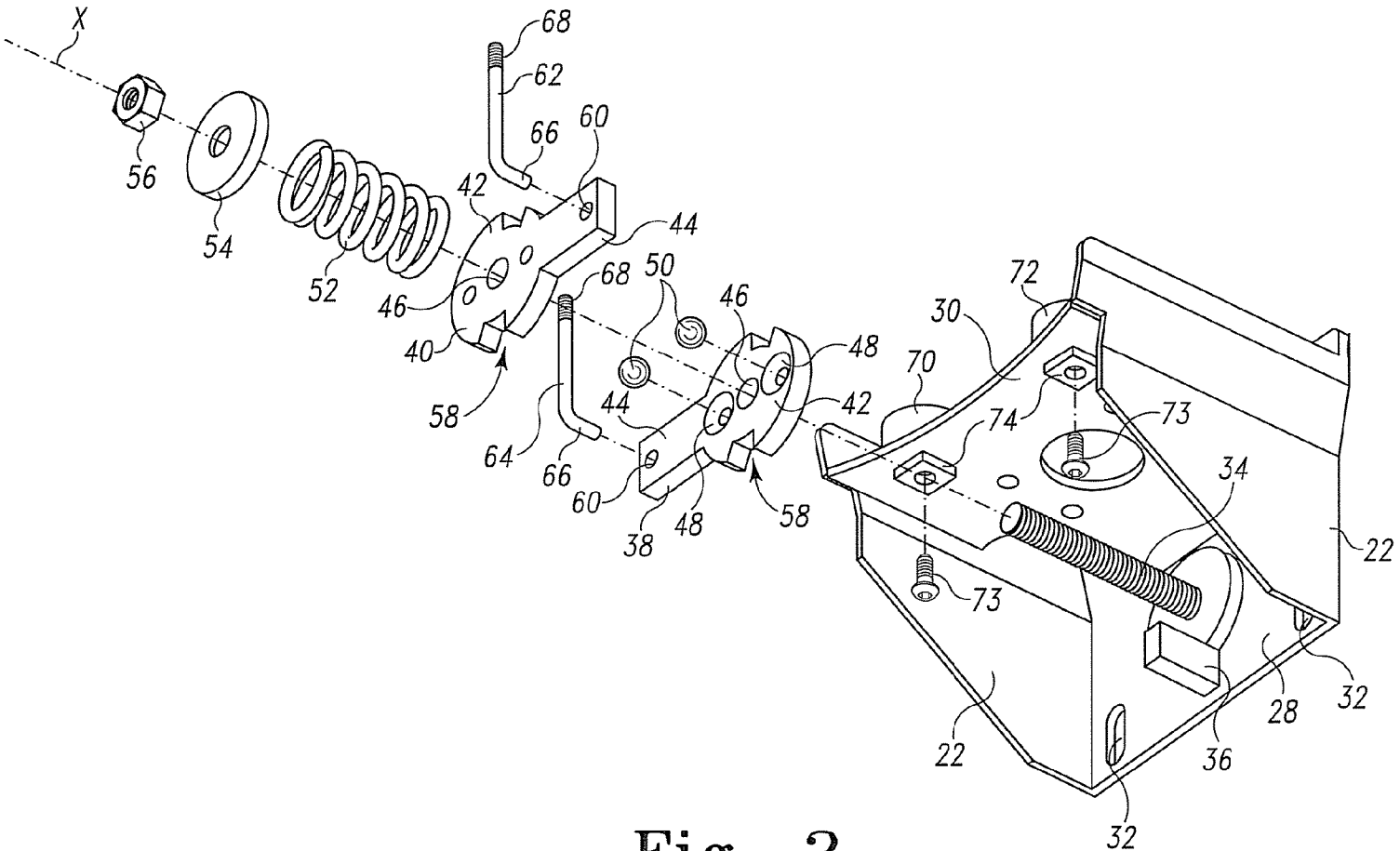
FIG. 2 is an exploded perspective view of a first embodiment of the present invention.

FIG. 2 shows that the bracket plates 22 are fixed to each other by a back plate 28 and a base plate 30. The back plate 28 can be fixed to the backboard 12 by suitable fasteners, not shown, that extend through openings 32 in the back plate 28. In this embodiment, a threaded member 34 projects outward from the back plate 28 to define an axis X that is generally perpendicular to the back plate 28 and backboard 12. A stop member 36 extends outward from the back plate 28 below the threaded member 34. Bumpers 70 and 72 can be secured to the top of the base plate 30 by fasteners 73 that can be received in nuts 74 fixed to the bottom of the base plate 30.

Figure 3:
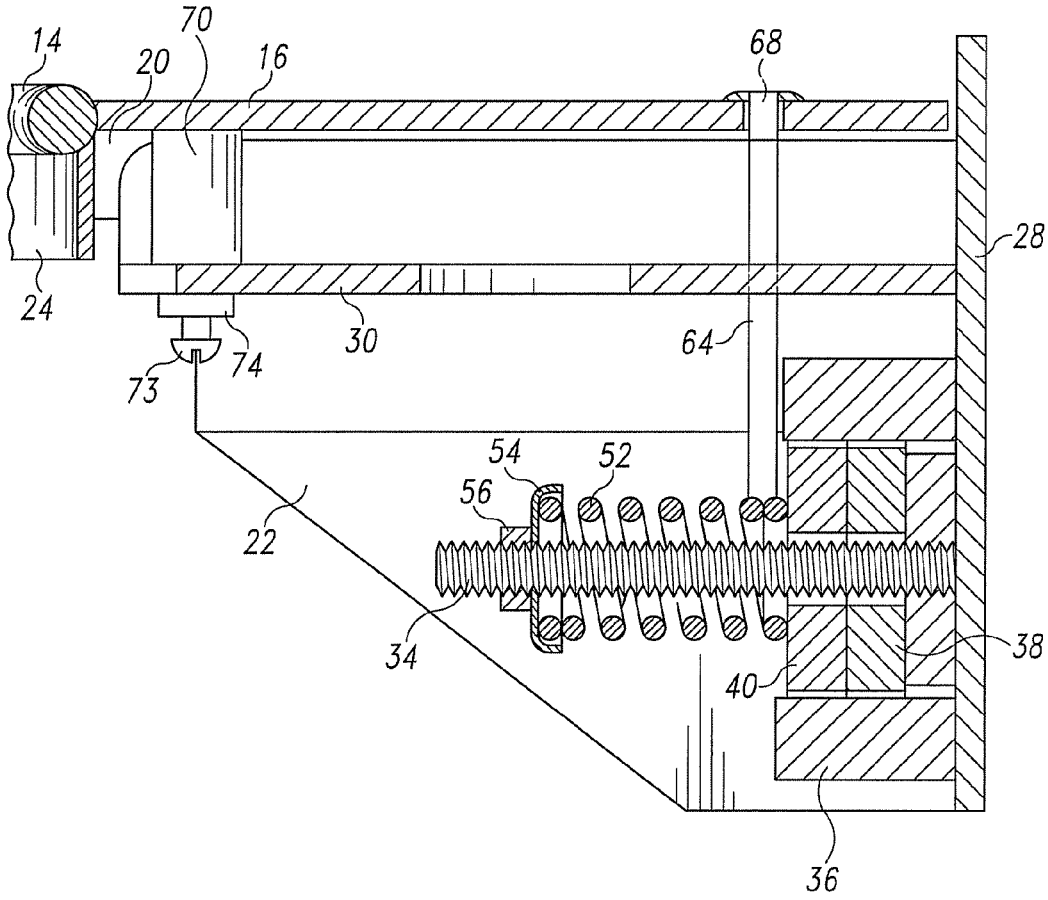
FIG. 3 is a vertical sectional view of the first embodiment of the present invention.
Figure 4:
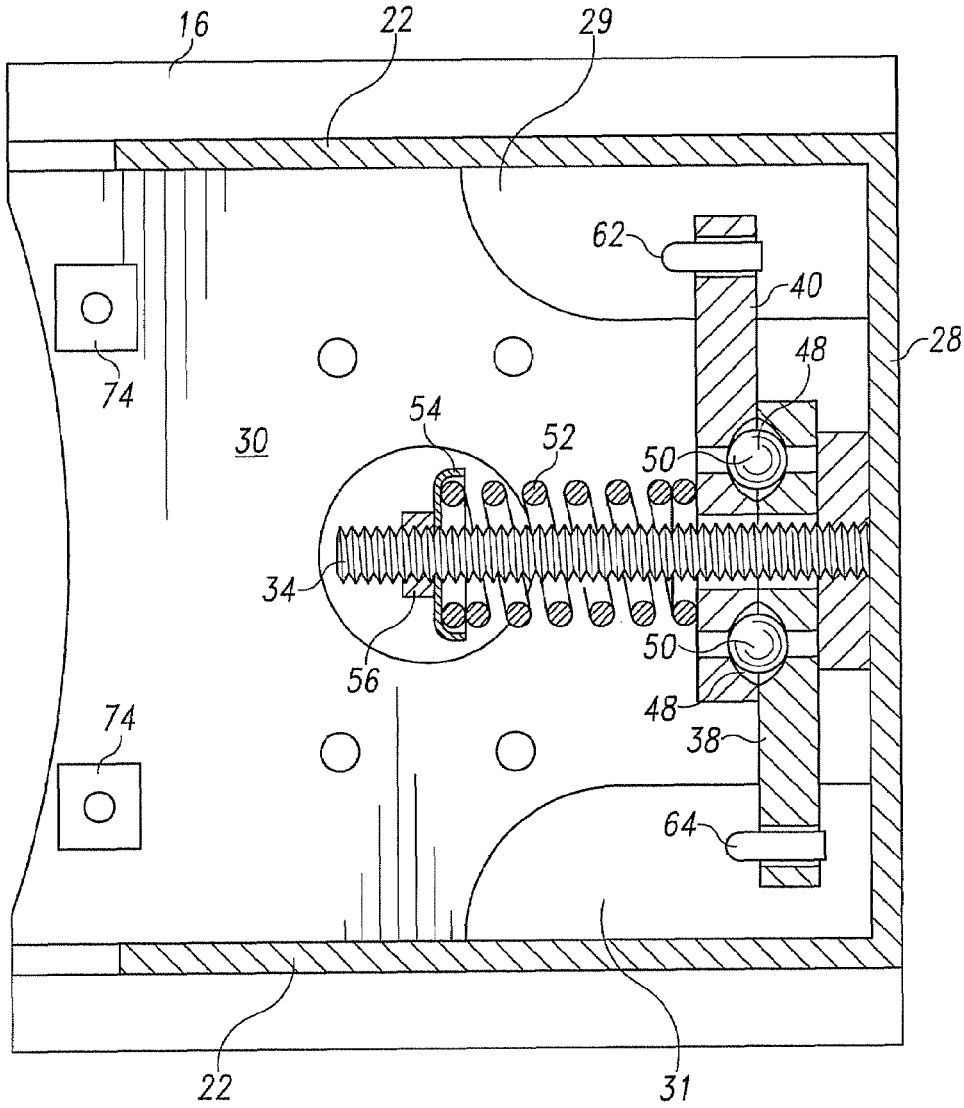
FIG. 4 is a horizontal sectional view of the first embodiment of the present invention, looking upward.
Figures 5, 5A:
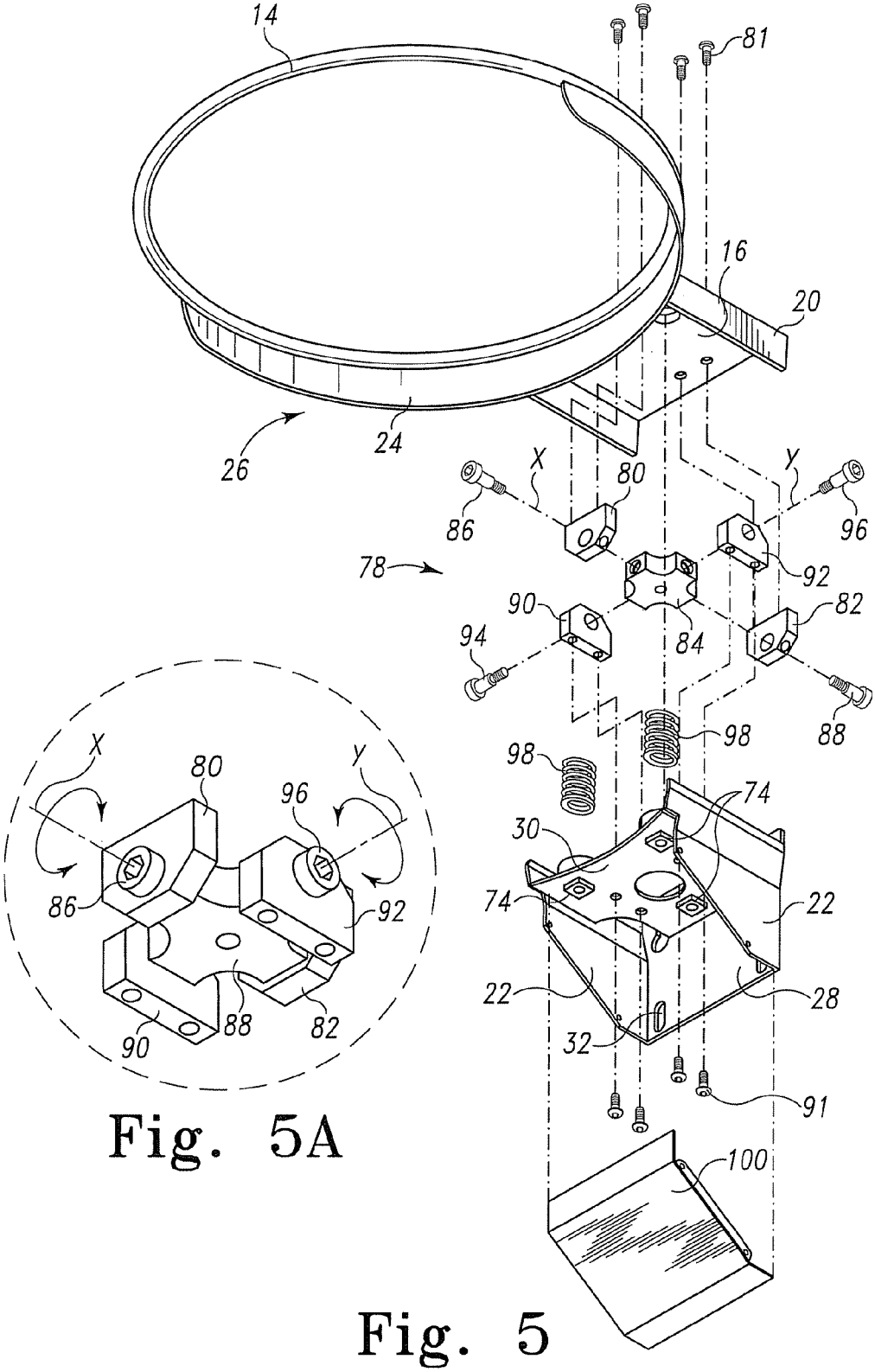
FIG. 5 is an exploded perspective view of a second embodiment of the present invention.
FIG. 5A is a detail perspective view of the pivot bridge member and connecting elements of the second embodiment of the present invention.

A first arm 38 and second arm 40 are shown in FIG. 2 to have similar construction. Each arm 38, 40 has a central body portion 42 and a lateral extension 44. The central body portion 42 includes a center opening 46 and two depressions 48. The center opening 46 permits the arms 38 and 40 to be received on the threaded member 34 as shown in FIG. 3. The two depressions 48 on arm 38 confront the two depressions 48 on arm 40. A spring 52, washer 54, and nut 56 are also received on the threaded member 34 to force the two arms 38 and 40 together with the balls 50 captured in the confronting depressions 48 as shown in FIG. 4. The arms 38 and 40 also include a notch 58 that receives the stop member 36 to limit the rotational displacement of the arms around the threaded member 34. The lateral extension 44 of each of the arms 38, 40 includes an opening 60. L-shaped connecting members 62 and 64 have one end 66 received in the openings 60 of the arms 38 and 40. The L-shaped connecting members 62 and 64 extend upward through lateral openings 29 and 31 of base plate 30. Upper ends 68 of the connecting members 62 and 64 can be connected to the top plate 16 of the movable portion 26. The forward portion of the top plate 16 is supported on bumpers 70 and 72. The height of the bumpers 70 and 72 can be adjusted by adjustment of the position of the fasteners 73 to ensure that the rim 14 is suitably positioned in relation to the backboard 12.

Any change in position of the rim 14, which might occur as a result of a dunk shot or a player hanging on the rim, causes a corresponding change in position of one or both of the L-shaped connecting members 62 and 64. A change in position of one or both of the L-shaped connecting members 62 and 64 will generally cause a relative rotational displacement of the corresponding arm or arms 38 and 40 such that the depressions 48 are skewed. The skewing of the depressions 48 causes the balls 50 captured in the confronting depressions 48 to force the arms 38 and 40 to separate against the biasing force provided by the spring 52. Since the force necessary to cause the rim to break-away from its normal position is regulated by the spring 52, it will be seen that it is the same in any direction regardless of where on the rim 14 the force might be applied. Upon release of the rim 14 from its displaced position, the biasing force provided by the spring 52 causes a realignment of the depressions 48 around the captured balls 50 so that the arms 38 and 40 are returned to their original position. This return of the arms 38 and 40 to their original position assures that the top plate 16 also returns to its original position.

Another embodiment of the basketball goal 78 is shown in FIGS. 5-8 that can be mounted to a vertical backboard 12, similar to FIG. 1, so that the rim 14 of the goal 10 is in the conventional horizontal position. As in FIG. 1, the rim 14, top plate 16, side plates 20 and reinforcement 24 are joined together to form a unitized structure that can move as a movable portion 26 in relation to the bracket plates 22, base plate 30, and back plate 28 that can be fixed to the backboard 12 by suitable fasteners, not shown, that extend through openings 32 in the back plate 28.

A first pair of bearings 80 and 82 is fixed by fasteners 81 to the lower surface of the top plate 16. A pivot bridge member 84 is coupled to the bearing members 80 and 82 by axles 86 and 88 that permit the pivot bridge member 84 to pivot about axis X. A second pair of bearings 90 and 92 is fixed by fasteners 91 to the top surface of the base plate 30. Axles 94 and 96 couple the pivot bridge member 84 to the second pair of bearings 90 and 92 so that the pivot bridge member 84 can pivot about an axis Y that is perpendicular to axis X as shown in detail in FIG. 5A. The axis X and axis Y are desirably located in a horizontal plane.

Figure 6:
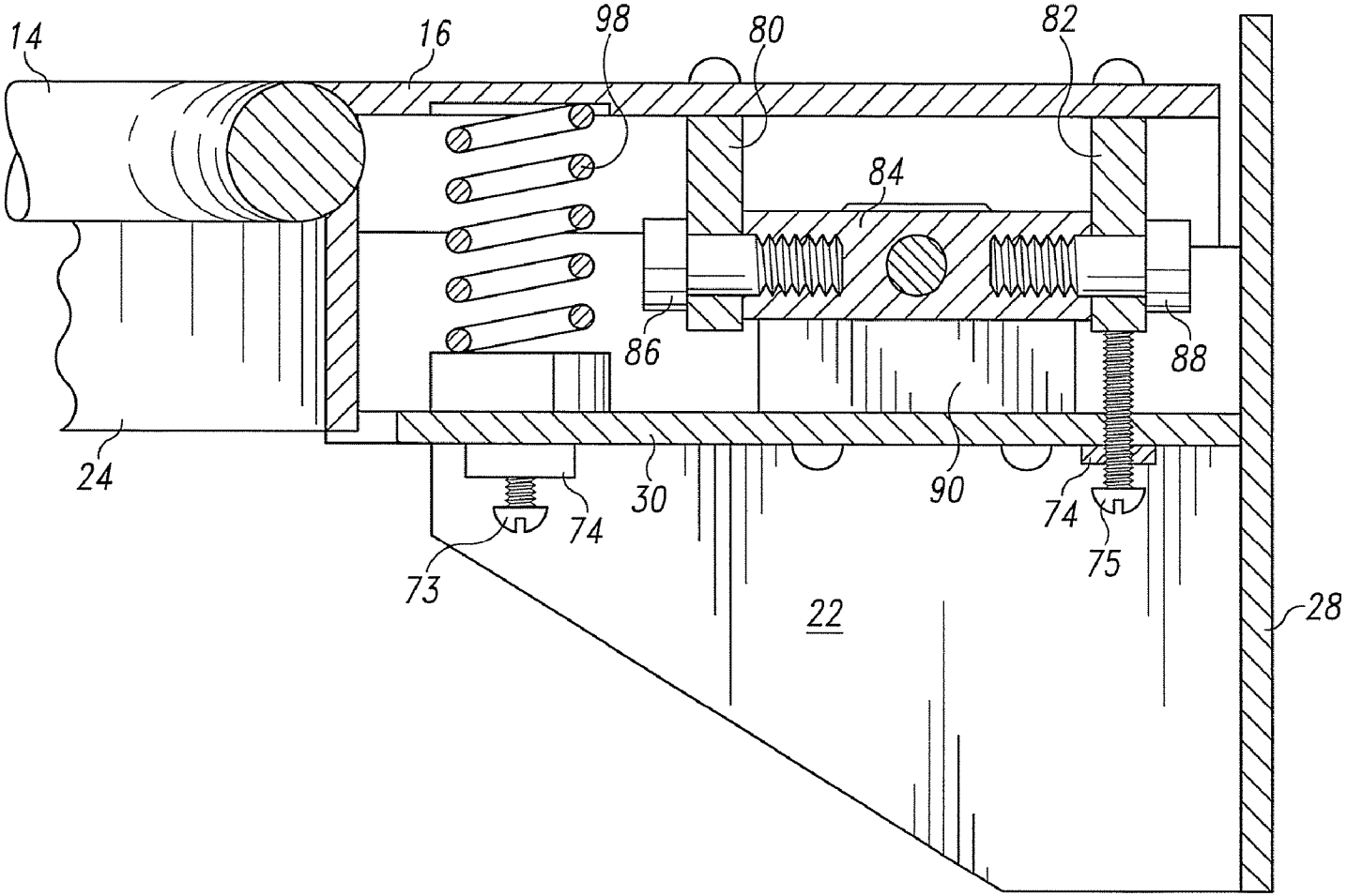
FIG. 6 is a vertical sectional view of the second embodiment of the present invention.

A pair of springs 98 is coupled to the base plate 30 by fasteners 73 passing through nuts 74. The pair of springs 98 extends upwardly from the base plate 30 to contact the top plate 16 as shown in FIG. 6. The fasteners 73 coupling the springs 98 to the base plate can be used to adjust the force applied between the base plate 30 and the top plate 16. A stop member 75 can be positioned to contact the lower surface of bearing 82 to define the pitch rest position of the top plate 16 and rim 14. The stop member 75 can be a threaded fastener that is adjustable to permit adjustment of the pitch rest position. The pair of springs 98 is located on opposite sides of the axis X so that the adjustment of the force applied by the springs 98 can be used to govern the roll rest position of the top plate 16 and rim 14, thus achieving the desired horizontal planar location of the X and Y axis.

Figure 7:
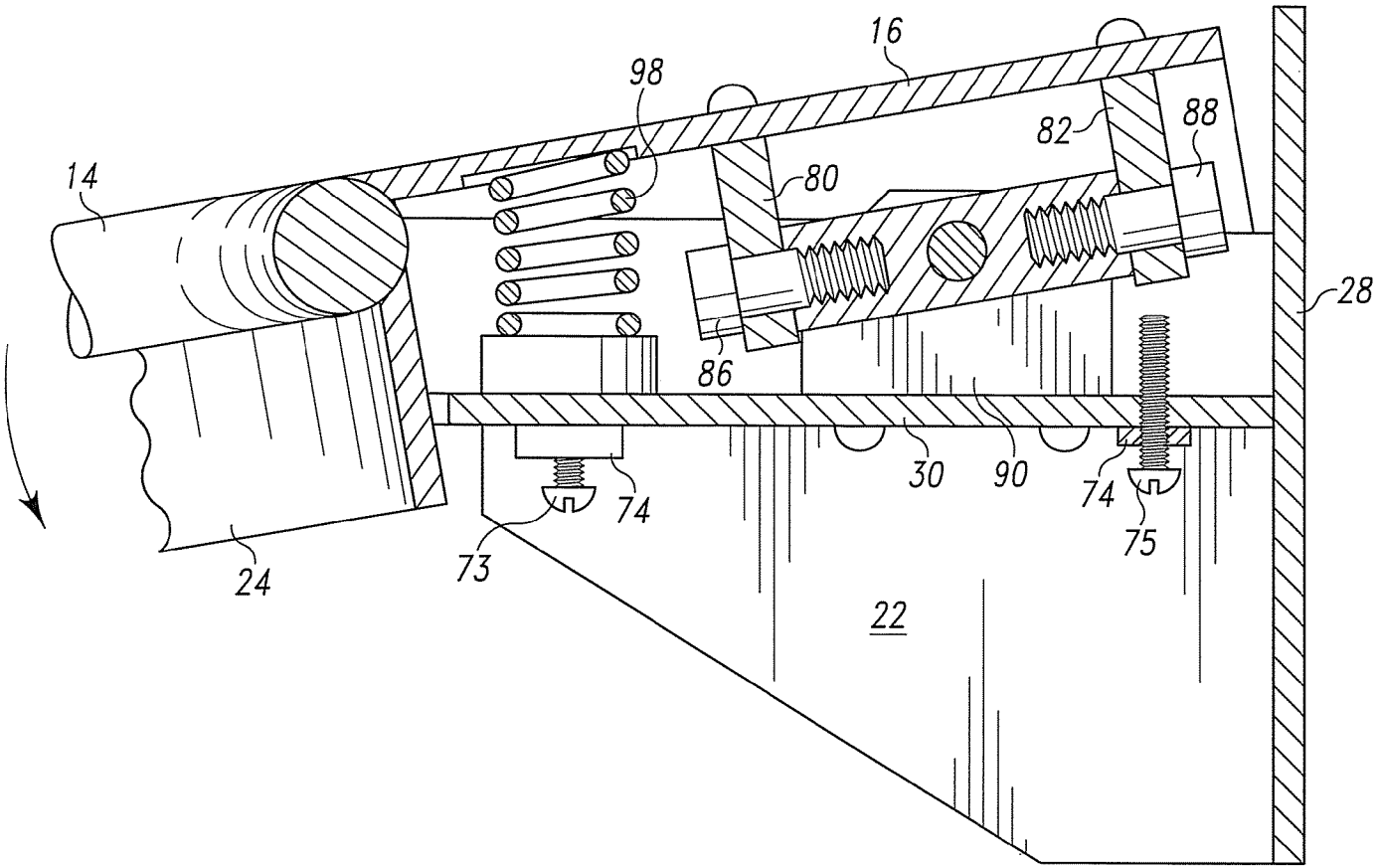
FIG. 7 is a vertical sectional view similar to FIG. 6 with the basket rim being deflected downward at the front of the rim.
Figure 8:
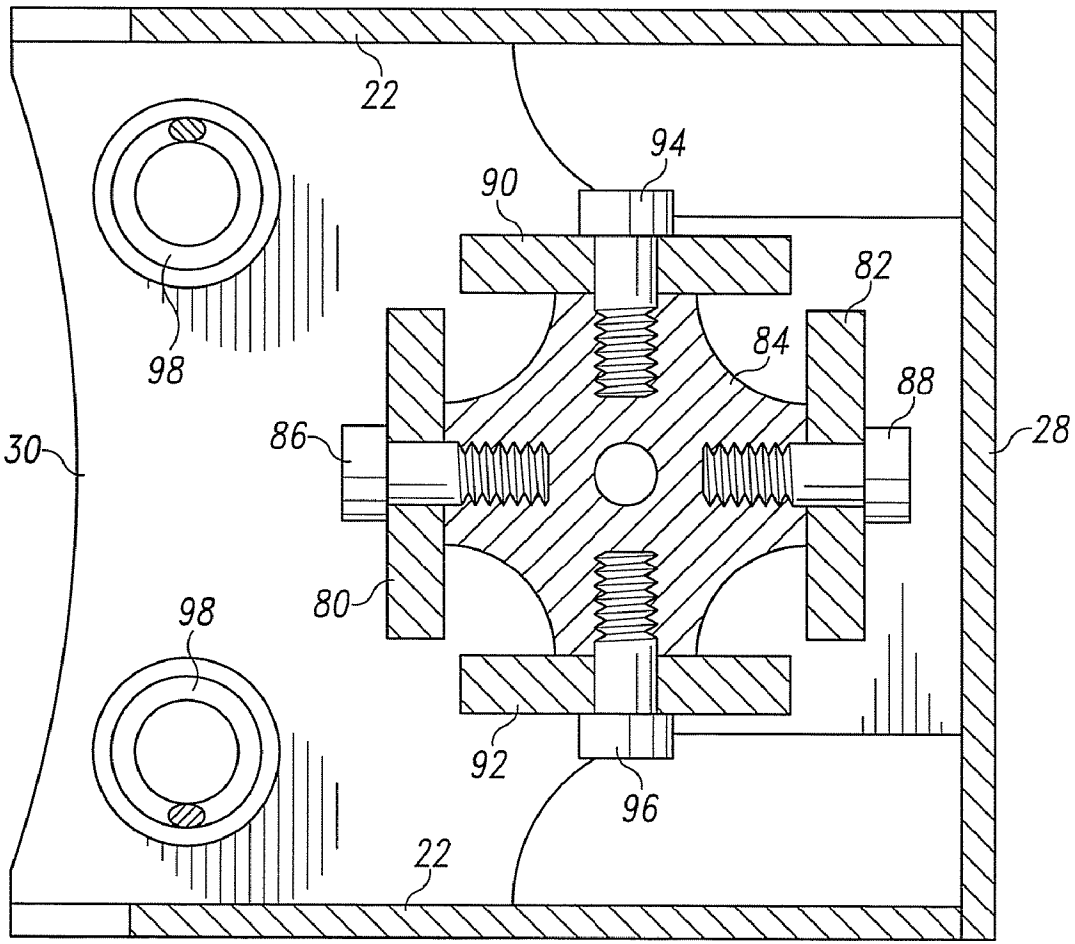
FIG. 8 is a horizontal sectional view of the second embodiment of the present invention, looking downward.

The rim support assembly of FIGS. 5-8 is such that any displacement of the rim 14, which might occur as a result of a dunk shot or a player hanging on the rim, causes a related change in position of the pivot bridge member 84 around one or both of the X axis and Y axis as shown in FIG. 7. The change in position also causes a compression or elongation of one or both of the springs 98. By suitable selection of springs 98 having substantially identical modulus, the force necessary to cause the rim 14 to break-away from its normal position is the same in any direction regardless of where on the rim 14 the force might be applied. Upon release of the rim 14 from its displaced position, the biasing force provided by the springs 98 causes a realignment of the top plate 16 relative to the base plate 30 as well as a net change in position of the pivot bridge member 84. Any unauthorized adjustment of the springs 98 and stop member 75 is inhibited by plate 100 that can be coupled to the bottom of the bracket plates 22.

While these features have been disclosed in connection with the illustrated preferred embodiment, other embodiments of the invention will be apparent to those skilled in the art that come within the spirit of the invention as defined in the following claims.

What is claimed is:

1. A basketball rim mounting assembly comprising: a fixed portion adapted to be coupled to a back board and a movable portion fixed to a basketball rim, the fixed portion including a back plate adapted to be secured to a front face of the back board, a pair of bracket plates fixed to extend forward from the back plate, and a base plate fixed between the bracket plates, the movable portion including a top plate overlying the base plate and a pair of side plates extending downward from the top plate outside the bracket plates, a pair of members fixed to the top plate in spaced relation to each other and extending downward therefrom, tilt regulating structure coupled to the pair of members and to the fixed portion controlling the extent of deflection of the rim and movable portion relative to the fixed portion and backboard and wherein each of the pair of members fixed to the top plate comprises an axis defining structure coupled to a pivot bridge member located between the pair of members forming a gimbaled connection between the movable portion and the fixed portion.

2. The basketball rim mounting assembly of claim 1, further comprising a cover plate connected to the bracket plates and covering the space between the bracket plates and below the base plate.

3. The basketball rim mounting assembly of claim 1, wherein each of the pair of members fixed to the top plate is coupled to one of a first arm and a second arm mounted on the fixed portion so that movement of the movable portion is translated into relative movement between the first and second arms.

4. A basketball rim mounting assembly comprising: a fixed portion adapted to be coupled to a back board, a movable portion fixed to a basketball rim, a pivot axis member fixed to the fixed portion, a first arm and a second arm mounted on the pivot axis member and coupled to the movable portion at spaced locations from each other, a biasing element resisting relative movement of the first and second arms, and at least one displacement element causing relative displacement between the first and second arms upon movement of the movable portion relative to the fixed portion and wherein each of the first and second arms include a pair of depressions, the depressions in the first arm confronting the depressions in the second arm and wherein at least one displacement element comprises a pair of balls received between the first and second arms in said depression.

5. The basketball rim mounting assembly of claim 4, further comprising a stop fixed to the fixed portion limiting the displacement of at least one of the first and second arms relative to the fixed portion.

6. The basketball rim mounting assembly of claim 5, wherein the stop comprises a projecting element extending parallel to the pivot axis member.

7. The basketball rim mounting assembly of claim 4, wherein the biasing element is mounted to the pivot axis member and exerts a compressive force against the first and second arms.

8. The basketball rim mounting assembly of claim 4, further comprising a pair of connecting members fixed to the movable portion, each connecting member being coupled to one of the first and second arms so that movement of the movable member is translated into relative movement between the first and second arms.

* * * * *

UNITED STATES PATENT AND TRADEMARK OFFICE

CERTIFICATE OF CORRECTION

PATENT NO. : 7,798,921 B2
APPLICATION NO. : 12/580659
DATED : September 21, 2010
INVENTOR(S) : James J. Connerley It is certified that error appears in the above-identified patent and that said Letters Patent is hereby corrected as shown below:

In the Claims

In Column 7, Line 20, insert --backboard-- after "and" and insert --and-- before "wherein".

Signed and Sealed this

Thirtieth Day of November, 2010

David J. Kappos

David J. Kappos
*Director of the United States Patent and Trademark Office*